United States Patent [19]

McKernan et al.

[11] Patent Number: 4,605,266

[45] Date of Patent: Aug. 12, 1986

[54] PIVOTED DRAWER LOCK MECHANISM

[75] Inventors: Thomas J. McKernan; Gordon C. Berry, both of Grand Rapids, Mich.

[73] Assignee: Haworth, Inc., Holland, Mich.

[21] Appl. No.: 662,670

[22] Filed: Oct. 19, 1984

[51] Int. Cl.[4] ..... E05B 65/46

[52] U.S. Cl. ..... 312/219; 312/220

[58] Field of Search ..... 312/107.5, 216, 215, 312/219, 217, 218, 220, 221

[56] References Cited

U.S. PATENT DOCUMENTS

| | | | |
|---|---|---|---|
| 1,036,442 | 8/1912 | Bullock | 312/107.5 |
| 2,835,547 | 5/1958 | Erismann | 312/219 |
| 3,857,620 | 12/1974 | Korell . | |
| 3,936,108 | 2/1976 | Ghitester | 312/219 |
| 3,998,508 | 12/1976 | Scheerhorn . | |
| 4,057,307 | 11/1977 | Scheerhorn . | |

*Primary Examiner*—William E. Lyddane

*Assistant Examiner*—Joseph Falk

*Attorney, Agent, or Firm*—Flynn, Thiel, Boutell & Tanis

[57] ABSTRACT

A drawer unit having a lock mechanism for controlling a plurality of drawers. The lock mechanism employs a vertically elongated lock bar having a plurality of vertically spaced locking tabs mounted thereon at selected intervals, which lock tabs are permanently fixed to the bar. The drawer unit employs a cabinet which mounts therein the plurality of drawers, which plurality can vary in number and/or size to permit the user to select the optimum drawer arrangement. Irrespective of the number and/or sizes of drawers selected, the same lock bar cooperates with and lockingly holds all of the drawers in a closed locked position when activated, without requiring any rearrangement of the lock bar. An open drawer can also be readily moved into its closed position without undue effort since the lock bar is displaced against the urging of a spring so as to permit the lock stop on the activated drawer to move therepast.

8 Claims, 8 Drawing Figures

PIVOTED DRAWER LOCK MECHANISM

FIELD OF THE INVENTION

This invention relates to a locking mechanism for locking a plurality of sliders in a selected position and, more specifically, to an improved key-operated locking mechanism for lockingly holding a plurality of drawers or similar slidable components in a closed position.

BACKGROUND OF THE INVENTION

File drawer units and the like, as used in offices and similar environments, are conventionally provided with a locking mechanism so as to securely lock the drawers in a closed position. Such mechanisms conventionally employ a key-operated lock device which is mounted so as to be accessible from the front side of the housing, which lock device acts through a suitable intermediate linkage for controlling a vertical lock bar which is disposed adjacent one of the corners of the housing. This lock bar in turn is provided with locking elements which cooperate with the individual drawers to securely lock them in their closed position. While numerous locking mechanisms of the above-described type have been devised and utilized, most such mechanisms employ a lock bar which is suitable only for one drawer configuration, or for use with a plurality of identically sized drawers, and hence do not permit a plurality of different-sized drawers to be readily positionally rearranged, or replaced with more or less drawers of different size. This has generally required the manufacturer to provide different lock mechanisms for different drawer units, and has prevented changing of the drawer arrangements after the units are installed in the field.

In an attempt to improve upon this disadvantage, one drawer unit is known which possesses a vertically elongated lock bar having multiple positions thereon for receiving removable locking tabs. The removable locking tabs can be selectively mounted on the lock bar at those positions corresponding to the location of the drawers and, when the different sizes of drawers are positionally rearranged, then the locking tabs can be positionally rearranged to correspond to the new drawer arrangement. While this obviously does increase the flexibility and adaptability of the unit both during manufacture and use, nevertheless this unit still requires that the correct number of locking tabs be initially selected, and then properly positioned and mounted on the lock bar at the correct locations, or in the alternative the removal and remounting of the lock tabs at the desired locations. A lock mechanism of this general type is illustrated by U.S. Pat. No. 3,857,620.

Another requirement of lock mechanisms of this general type is the necessity that the mechanism permit an opened drawer to be returned to its closed position, even when the lock mechanism is already in its locked position. While the mechanism of the aforesaid patent does permit closing of a drawer when the lock mechanism is in its locked position, nevertheless this drawer closing function requires that the locking tab be provided with a complex three-dimensional configuration to cam the entire lock bar vertically upwardly so as to permit the opened drawer to be moved therepast during its closing movement. The mechanism of this patent employs a positive linkage between the lock device and the lock bar, and hence requires lifting of the lock bar to permit the closing of a drawer when the mechanism is locked.

Accordingly, it is an object of this invention to provide an improved lock mechanism for controlling a plurality of drawers or similar slidable units, which lock mechanism possesses the essential performance features but in addition overcomes the above-mentioned disadvantages. More specifically, the lock mechanism of this invention employs a vertically elongated lock bar having a plurality of vertically spaced locking tabs mounted thereon at selected intervals, which lock tabs are permanently fixed to and remain on the bar at all times. The drawer unit employs a cabinet which mounts therein a plurality of drawers, which plurality can vary in number and/or size so as to permit the user to select the optimum drawer arrangement. Irrespective of the number and/or sizes of drawers selected, however, and/or the positional arrangement thereof, the same lock bar still cooperates with and lockingly holds all of the drawers in a closed locked position when activated, without requiring any prepositioning or rearrangement of the lock bar. In addition, when the lock mechanism is activated into a locked position, an open drawer can still be readily moved into its closed position without undue effort since the lock bar will readily displace against the urging of a spring so as to permit the lock stop on the activated drawer to move therepast, following which the lock bar again automatically returns to its closed and hence locking position.

Other objects and purposes of the invention will be apparent to persons familiar with mechanisms of this general type upon reading the following specification and inspecting the accompanying drawings.

Figure 1:
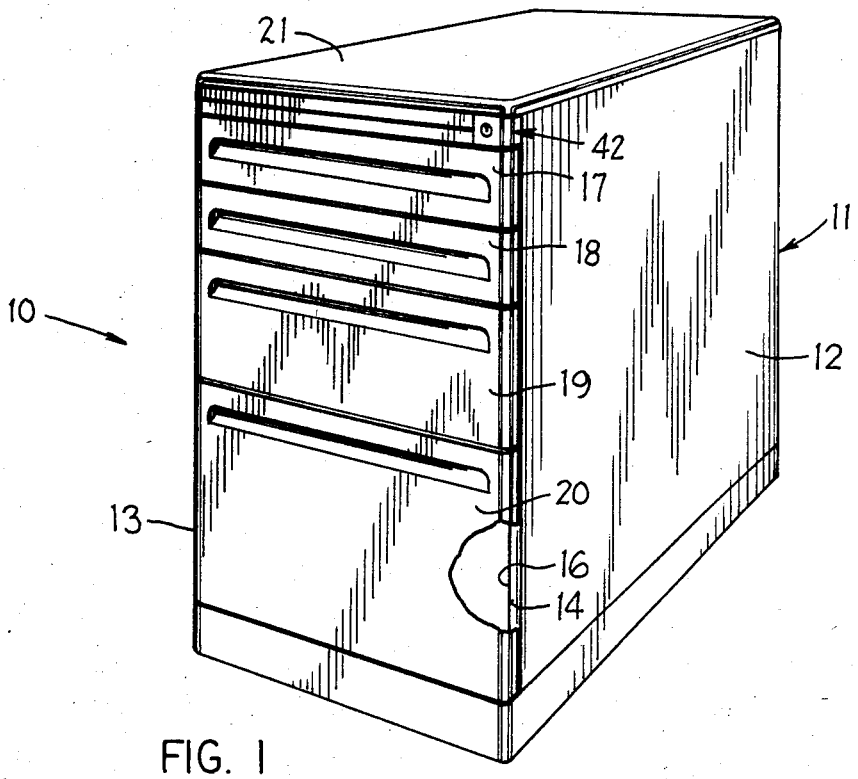
FIG. 1 is a perspective view of a drawer unit mounting therein a plurality of drawers or slides.
Figure 2:
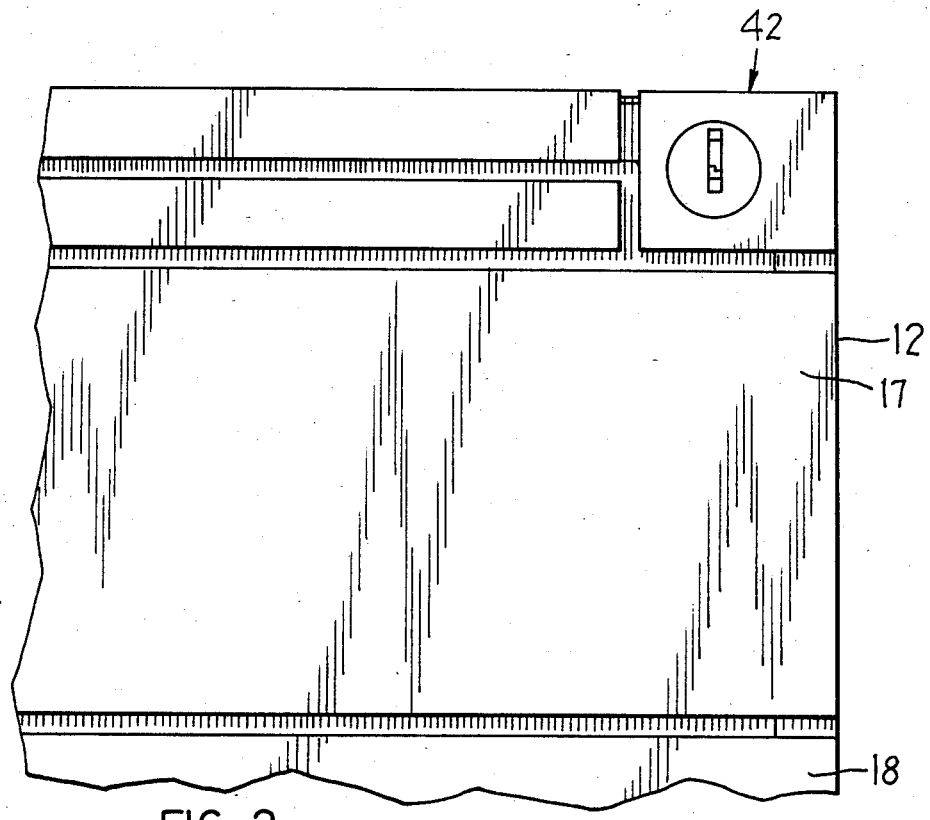
FIG. 2 is an enlarged, fragmentary front view showing an upper corner of the front of the drawer unit.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the side of the drawer unit as appearing in FIG. 1 through which the individual drawers open. The words "inwardly" and "outwardly" will refer to movement of the individual drawer units in a closing and an opening direction, respectively. The words "inwardly" and "outwardly" will also refer to directions toward and away from the geometric center of the drawer unit and designated parts thereof. Said terminology will include the words specifically mentioned, derivatives thereof, and words of similar import.

DETAILED DESCRIPTION

Referring to the drawings, and specifically FIG. 1, there is illustrated a drawer unit 10 which includes a hollow boxlike cabinet or housing 11 as defined by substantially parallel right and left sidewalls 12 and 13, respectively, rigidly joined together by a front wall 14 and a rear wall (not shown). The front wall 14 has a large and substantially rectangular drawer-receiving opening 16 formed therein for accommodating the fronts of a plurality of drawers disposed in adjacent relationship vertically one above the other. The drawer unit in the illustrated embodiment has four drawers or like slidable components mounted thereon and designated 17, 18, 19 and 20.

The cabinet also has a top wall 21 which, in the preferred embodiment, is removably attached to the cabinet. This removable attachment can be accomplished in many conventional ways but is preferably accomplished by means of spring clips (not shown) which are fixed to and project downwardly from the top wall and releasably engage the cabinet adjacent the corners thereof.

Each of the cabinet sidewalls 12 and 13 has a pair of vertically elongated channel members 22 fixed thereto, one channel 22 being fixed to each sidewall adjacent the respective rear corner, and the other channel being fixed to the respective sidewall adjacent the respective front corner. Only one such channel 22 is illustrated in the drawings, specifically in FIGS. 3 and 4, which channel is positioned adjacent the right front corner of the cabinet. The channel member 22 has the base or web 22' thereof spaced inwardly from the respective sidewall to define a clearance space therebetween. The web 22' of each channel 22 has a plurality of openings 23 formed therethrough, which openings are preferably square or rectangular. The openings 23 are vertically spaced at uniform intervals along the channel, the spacing between each adjacent pair of openings being designated N. This spacing N in the preferred embodiment is three inches.

To support each of the drawers (such as 17, 18, 19 or 20) for horizontal slidable displacement relative to the cabinet between opened and closed positions, each drawer is supported by a pair of conventional slide mechanisms which coact between opposite sides of the respective drawer and the adjacent sidewalls 12 and 13. These slide mechanisms normally comprise an inner track 24 which is fixed to the sidewall of the drawer and is suitably rollingly or slidably engaged for slidable extension relative to an outer track 26 which is stationarily supported on the respective sidewall 12 or 13. The tracks 24 and 26 are either directly rollingly engaged with one another, or are joined together through an intermediate roller-supporting track so as to permit full-length drawer extension. Tracks of both types are conventional and well known, and examples of same are illustrated by U.S. Pat. Nos. 3,050,348 and 3,431,042, so that further description of the drawer slides is believed unnecessary.

In the drawer unit of this invention, the outer rail or track 26 associated with each drawer slide has a substantially L-shaped mounting flange 27 which projects outwardly therefrom adjacent the front and rear ends of the track. This mounting flange is adapted to project through a selected one of the openings 23, whereby the front and rear ends of the respective track 26 can hence be mounted on the channels 22 provided adjacent the front and rear corners of the respective sidewall. This enables each track 24 to be stationarily mounted on and adjacent the inner side of the respective sidewall 12 or 13. At the same time, the track can also be removed and repositioned at a different elevation by being reengaged with a different pair of horizontally aligned holes 23. This movement capability of the outer tracks hence enables the drawers 17–20 to have their positions changed, or alternately additional tracks can be added to or removed from the cabinet so as to permit either more or less drawers of different sizes to be utilized in the cabinet.

For example, the drawer unit in the illustrated embodiment has four drawers 17–20 mounted thereon. These drawers are provided with heights which are all a whole integer multiple of the spacing N, that is a height nN, where "n" equals 1, 2, 3, . . . In the illustrated embodiment, the drawers 17 and 18 are three-inch drawers, the drawer 19 is a six-inch drawer, and the drawer 20 is a twelve-inch drawer. The drawer opening hence has a height of 24 inches. Within this same drawer opening of 24 inches, however, the cabinet could be modified so as to accommodate any other combination of drawers (such as any combination of three-, six-, nine-, twelve- or fifteen-inch drawers) which equals 24 inches. For example, the twelve-inch drawer could be replaced with two six-inch drawers, or the six-inch drawer could be replaced with two three-inch drawers. Further, the drawers can be changed as desired, such that changing of the position of the drawers, or the adding or removing of drawers due to a change in the size of the drawers, can be readily accomplished by adding or removing drawer slides, specifically the rails 26, at the desired locations as defined by the holes 23.

The drawer unit of this invention includes a key-operated lock mechanism 41 for securely locking all of the drawers in their closed positions. The lock mechanism 41 is effective for simultaneously holding all of the drawers in a locked position, irrespective of the number or rearrangement of the drawers as explained above, without requiring any rearrangement or modification of the lock mechanism.

The lock mechanism 41 is mounted interiorly of the cabinet adjacent one of the front corners thereof, preferably the right front corner. The lock mechanism includes a key-operated lock 42 which is mounted so as to be accessible from the front side of the drawer unit, the key-operated lock 42 preferably being mounted adjacent the upper right front corner of the front wall. This key-operated lock 42 in turn controls an activating mechanism 43 which is positioned interiorly of the cabinet adjacent the upper right front corner, and this activating mechanism in turn controls the position of a swingable lock bar 44.

The key-activated lock 42 is of conventional construction and includes an outer sleeve 46 which is fixedly positioned in the front wall and has a conventional key-receiving core 47 rotatably supported therein. This rotatable core has, on its inner axial end, a rearwardly projecting drive or crank pin 48 disposed in eccentric relationship with respect to the rotational axis of the core 47. This crank pin 48 is slidably accommodated within a narrow but vertically elongated slot 49 formed in a slide 51, the latter being confined for horizontal slidable displacement within a guide channel 52 defined on the inner surface of the front wall.

Figure 3:
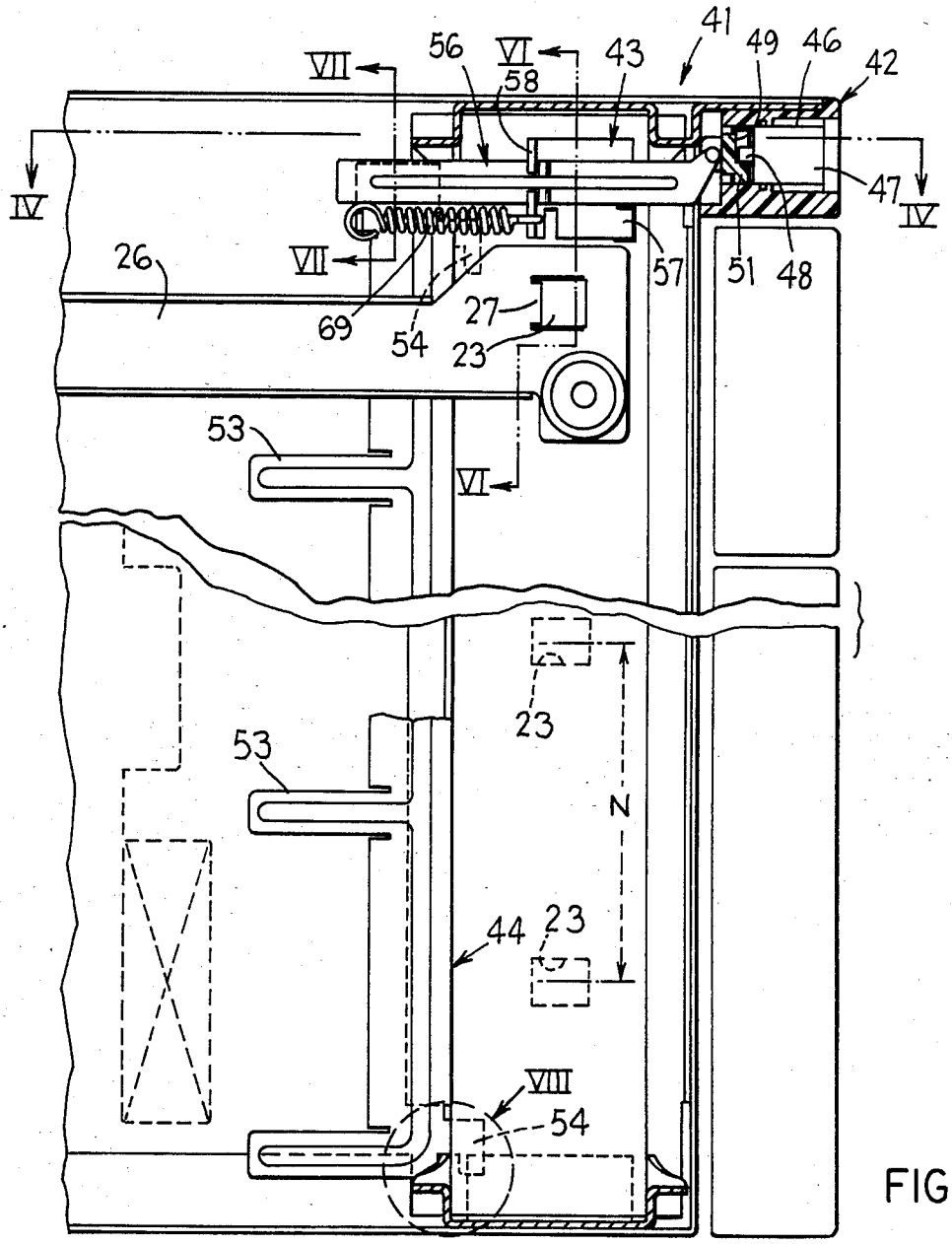
FIG. 3 is an enlarged, fragmentary, cross-sectional elevational view illustrating the locking mechanism as positioned within the drawer unit housing adjacent the right front corner thereof as appearing in FIG. 1.
Figure 8:
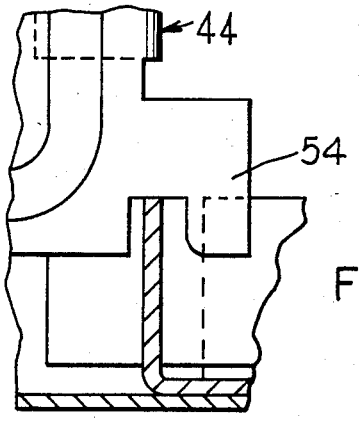
FIG. 8 is an enlarged, fragmentary sectional view of the area designated VIII in FIG. 3.
Figure 4:
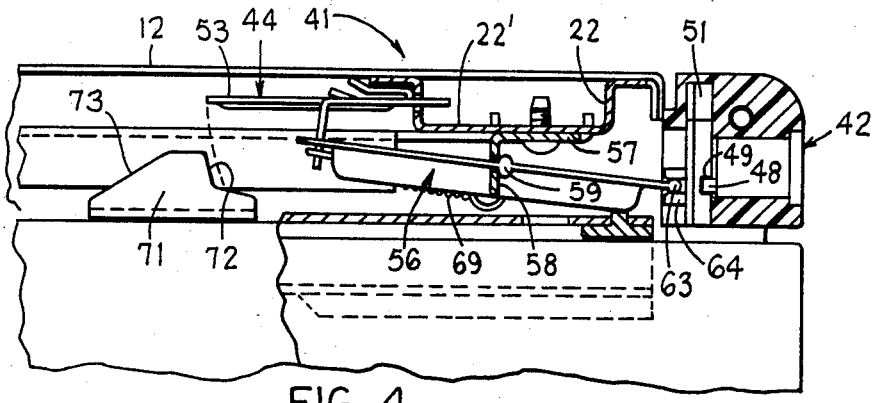
FIG. 4 is a fragmentary sectional view taken substantially along line IV—IV in FIG. 3, this view illustrating the lock mechanism in its unlocked position.

The lock bar 44, as illustrated by FIGS. 3 and 4, is vertically elongated and is positioned interiorly of the cabinet closely adjacent the right front corner so that the lock bar hence extends throughout substantially the full height of the cabinet. The lock bar has a plurality of locking tabs or lugs 53 fixedly, here integrally, joined thereto and projecting outwardly therefrom generally toward the rear of the cabinet in a substantially cantilevered relationship. These locking tabs 53 are uniformly spaced vertically of the lock bar at intervals "N" equal to the spacing between the holes 23. The lock bar has substantially L-shaped mounting tabs 54 formed thereon adjacent the upper and lower ends thereof, and these tabs 54 project through suitable vertically elongated slots formed in the sidewall of the respective channel 22 so as to support the lock bar 44 for substantially horizontal swinging movement between the locking and unlocking positions illustrated by FIGS. 4 and 5, respectively.

The activating mechanism 43 includes an elongated activating lever 56 which is pivotally supported in the middle region thereof and has the opposite ends thereof interconnected for cooperation with the slide block 51 and lock bar 44, respectively. The activating lever 56 is supported on the cabinet by means of a bracket 57 which is secured to the channel 22 adjacent the upper end thereof. For this purpose, the bracket is substantially L-shaped and includes a base leg which overlaps the channel web 22' and is fixedly secured thereto, as by a screw, and also includes an outwardly projecting leg 58 which has a slot therein for accommodating the lever 56 substantially adjacent the midpoint thereof, whereby this leg 58 hence functions as a fulcrum for the activating lever. The activating lever 56 has a pin or riblike enlargement 59 which is positioned directly adjacent the front side of the leg 58 so as to retain the lever in position with respect to the bracket.

Figure 7:
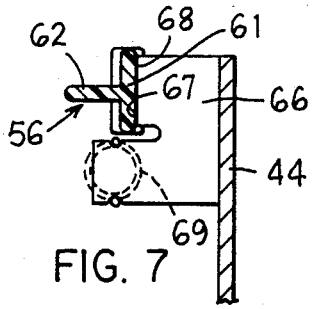
FIG. 7 is a fragmentary sectional view taken substantially along the line VII—VII in FIG. 3.

The activating lever 56 is, as illustrated by FIG. 7, of a substantially T-shaped cross section, the lever being oriented so that the head 61 of the "T" is disposed closest to the sidewall of the cabinet, whereas the leg 62 of the T projects horizontally inwardly toward the interior of the cabinet.

The head 61 of the activating lever 56, adjacent the front free, end thereof, has a vertically elongated pintle 63 formed integrally therewith, which pintle 63 is pivotally supported and confined within the vertically elongated socket part 64 which is fixedly associated with and projects rearwardly of the slide 51. Hence, slidable displacement of the slide 51 causes horizontal rocking or pivoting movement of the activating lever 56 about the fulcrum defined by the bracket leg 58.

Figure 5:
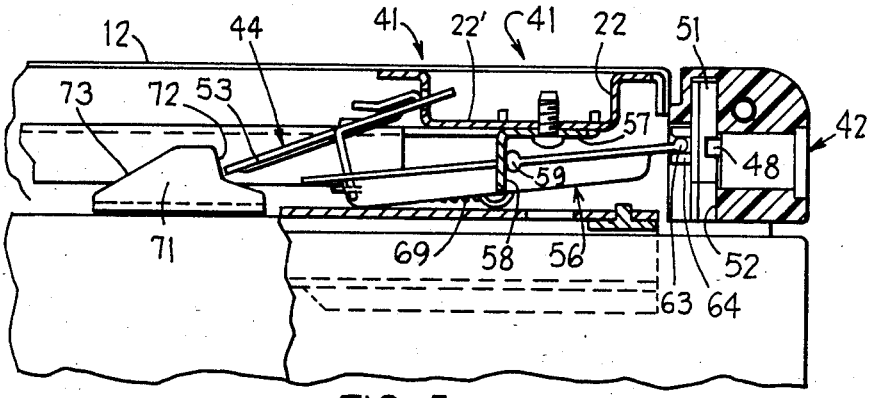
FIG. 5 is a view similar to FIG. 4 but illustrating the lock mechanism in its locked position.
Figure 6:
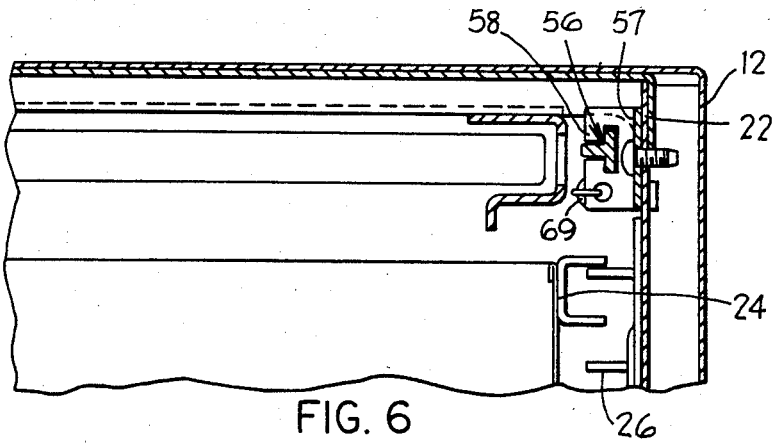
FIG. 6 is a fragmentary sectional view taken substantially along the line VI—VI in FIG. 3.

The other end of the activating lever 56 is adapted to cooperate with the lock bar 44 to effect pivotal movement thereof from the lock position of FIG. 5 into the release position of FIG. 4. For this purpose, the lock bar 44 is provided, adjacent the upper end thereof, with a sidewardly projecting tab or leg 66 which, on the free end thereof, defines an edge or surface 67 which is normally maintained in abutting engagement with the side surface 68 of the activating lever 56 adjacent the free end thereof. To maintain these surfaces 67–68 in normal engagement with one another, a coiled tension spring 69 is provided for normally biasing the lock bar 44 towards its locked position of FIG. 5. One end of tension spring 69 is anchored to the projecting leg 58 of bracket 57, and the other end is anchored to the sidewardly projecting tab 66 on the lock bar 44. The anchor points for the ends of this tension spring are located such that the spring 69 is extended when in the unlocked position of FIG. 4, and undergoes a slight contraction when the lock bar 44 moves into the locked position of FIG. 5, whereby the spring 69 hence continuously urges the lock bar 44 toward the locked position.

To maintain each drawer in the locked position of FIG. 5, each drawer has a locking stop 71 secured to the sidewall thereof at an elevation whereat it is disposed for cooperation with one of the locking lugs 53 associated with the locking bar 44. This locking stop 71 has a locking surface 72 formed on the forward side thereof so as to permit the free end of the locking lug 53 to be positioned in front thereof, as illustrated by FIG. 5, whereby outward (i.e. opening) movement of the drawer is positively prevented. The locking stop 71 also has a rear surface 73 which defines a tapered cam so that, in the event that the locking bar 44 is in its locked position and a drawer is in an open position, the drawer can be moved inwardly whereupon the cam surface 73 momentarily outwardly deflects the locking bar 44 so as to enable the drawer to move rearwardly therepast, following which the locking bar automatically returns to the locking position.

In operation, the lock mechanism will normally be maintained in the released position illustrated by FIG. 4. However, when locking of the drawers is desired, then the key is inserted into the lock core 47 so as to effect rotation thereof through about 180°. This hence causes displacement of the slider 51, which in turn effects pivoting of the activating lever 56 into the FIG. 5 position. This movement of the activating lever 56 away from the lock bar 44 hence also enables the lock bar to swingably move into its locking position due to the urging of the spring 69. The locking lugs 53 on the lock bar 44 are hence positioned in front of the lock stops 71 on the drawers, and thus prevent opening of the drawers.

In the event that any drawer is in an open or partially open position when the lock mechanism is locked, the drawer can be freely moved to its closed position, whereupon the lock stop 71 will momentarily swing the lock bar 44 outwardly away from its closed position, whereupon the lock bar will again be spring-urged back to its locking position after the lock stop has moved therepast.

When unlocking of the drawers is desired, then the lock 42 is again rotatably returned to its position illustrated in FIG. 4, and this causes the activating lever 56 to swing outwardly into the release position of FIG. 4. The free end of the activating lever 56 bears against the surface 67 on the projecting tab 66 of the lock bar, thereby pushing the lock bar 44 into the release position in opposition to the urging of spring 69. The activating lever 56 then positively holds the locking bar in this unlocked or released position.

While the present invention makes reference to a drawer unit, it will be recognized that the drawer unit may comprise either a free-standing unit or may be suspended from beneath a work surface. The drawer unit of this invention may also provide a support for a work surface, such as a desk pedestal.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a drawer unit having a housing, a plurality of drawers disposed vertically above one another and movably supported on said cabinet for substantially linear movement between open and closed positions, each said drawer having a lock stop thereon, and a locking mechanism for lockingly retaining said drawers in said closed position, the improvement wherein said locking mechanism comprises:

a vertically elongated lock bar disposed within and supported on said housing for swinging movement about a substantially vertical axis between locking and unlocking positions, said lock bar having a plurality of locking tabs fixedly and permanently attached thereto and projecting outwardly therefrom for individual cooperation with the lock stops on the drawers when the latter are in said closed position, said locking tabs being uniformly vertically spaced apart;

spring means normally urging said lock bar to swing inwardly toward said locking position for causing said locking tabs to be positioned in front of the lock stops on the drawers when the latter are in said closed position;

a key-operated rotary lock unit mounted on said housing and being accessible from the exterior thereof, said lock unit including a rotary actuator provided with an eccentric crank thereon; and activating means coacting between said rotary crank and said lock bar for positively effecting displacement of the latter into said unlocking position in opposition to the urging of said spring.

2. A unit according to claim 1, wherein said activating means includes an activating lever having one end thereof drivingly coupled to said crank, said activating lever being pivotally supported on said housing at a location disposed intermediate the ends of said lever, and said activating lever having the other end thereof disposed for abutting engagement with said lock bar to positively displace said lock bar from said locking position to said unlocking position in response to swinging movement of said activating lever caused by rotational unlocking of said lock unit.

3. A drawer unit according to claim 2, wherein said housing includes vertical support posts fixedly associated therewith and positioned interiorly thereof adjacent each side of the housing in the vicinity of the front and rear corners thereof, said plurality of drawers including at least one drawer having a height substantially corresponding to the spacing between said locking tabs, and at least one drawer having a height greater than but equal to a whole-number multiple of the spacing between said locking tabs, the number of drawers being less than the number of locking tabs associated with said lock bar.

4. In a drawer unit having a housing, a plurality of drawers disposed vertically above one another and movably supported on said housing for substantially linear movement between open and closed positions, each said drawer having a lock stop projecting sidewardly therefrom, and a locking mechanism for lockingly retaining said drawers in said closed position, the improvement wherein said locking mechanism comprises:

a vertically elongated lock bar disposed within and supported on said housing adjacent a front corner thereof for swinging movement about a substantially vertical axis between locking and unlocking positions, said lock bar having a plurality of locking tabs fixedly and permanently attached thereto and projecting horizontally outwardly therefrom for individual cooperation with the lock stops on the drawers when the latter are in said closed position, said locking tabs being uniformly vertically spaced apart;

spring means normally urging said lock bar to swing inwardly toward said locking position for causing said locking tabs to be positioned in front of the lock stops on the drawers when the latter are in said closed position;

a key-operated rotary lock unit mounted on said housing in the vicinity of said front corner and being accessible from a front side of said housing, said lock unit including a rotary actuator provided with an eccentric crank thereon; and activating means coacting between said rotary crank and said lock bar for positively effecting displacement of the latter into said unlocking position in opposition to the urging of said spring;

said activating means including an elongated activating lever which is disposed adjacent a side wall of the housing and is horizontally elongated in the front-to-rear direction of the housing, said elongated activating lever being pivotally supported intermediate its length by the housing for pivoting movement about a substantially vertical axis, said activating lever having a front end thereof pivotally coupled to said crank, said activating lever having the other end thereof disposed for abutting engagement with said lock bar to positively displace said lock bar from said locking position to said unlocking position in response to swinging movement of said activating lever caused by rotational unlocking of said lock unit.

5. A unit according to claim 4, wherein said activating means includes an intermediate slide which is slidably supported on said housing adjacent said front corner for horizontal linear displacement, said slide being pivotally coupled to said one end of said activating lever and being slidably engaged with the eccentric crank so that the slide is linearly displaced in response to rotation of the rotary actuator.

6. A unit according to claim 5, wherein said plurality of drawers includes at least one drawer having a height substantially corresponding to the spacing between said locking tabs, and at least one drawer having a height greater than but equal to a whole-number multiple of the spacing between said locking tabs, the number of drawers being less than the number of locking tabs associated with said lock bar.

7. A unit according to claim 4, wherein said plurality of drawers includes at least one drawer having a height substantially corresponding to the spacing between said locking tabs, and at least one drawer having a height greater than but equal to a whole-number multiple of the spacing between said locking tabs, the number of drawers being less than the number of locking tabs associated with said lock bar.

8. A unit according to claim 4, wherein said locking bar is solely movable in a pivoting manner about said vertical axis when being displaced between said locking and unlocking positions whether activated by the lock unit or by the closing of a drawer.

* * * * *